US008047121B2

(12) United States Patent
Yamamoto et al.

(10) Patent No.: US 8,047,121 B2
(45) Date of Patent: Nov. 1, 2011

(54) WORKING MACHINE, AND QUICK LOAD-DROPPING METHOD

(75) Inventors: Shigeru Yamamoto, Hirakata (JP); Tomohiro Nakagawa, Hirakata (JP); Satoru Shintani, Hirakata (JP)

(73) Assignee: Komatsu Ltd., Tokyo (JP)

( * ) Notice: Subject to any disclaimer, the term of this patent is extended or adjusted under 35 U.S.C. 154(b) by 740 days.

(21) Appl. No.: 12/279,912

(22) PCT Filed: Apr. 4, 2007

(86) PCT No.: PCT/JP2007/057528

§ 371 (c)(1),
(2), (4) Date: Aug. 19, 2008

(87) PCT Pub. No.: WO2007/116896

PCT Pub. Date: Oct. 18, 2007

(65) Prior Publication Data

US 2009/0007772 A1 Jan. 8, 2009

(30) Foreign Application Priority Data

Apr. 6, 2006 (JP) ..... 2006-105520

(51) Int. Cl.
*F15B 13/042* (2006.01)

(52) U.S. Cl. ..... 91/436; 91/448

(58) Field of Classification Search ..... 91/1, 436, 91/444, 448, 461

See application file for complete search history.

(56) References Cited

U.S. PATENT DOCUMENTS

| | | | | |
|---|---|---|---|---|
| 3,965,587 | A * | 6/1976 | Johns, Jr. | 91/436 |
| 5,226,348 | A | 7/1993 | Dezelan et al. | |
| 5,370,038 | A * | 12/1994 | Poppe et al. | 91/436 |
| 5,682,955 | A | 11/1997 | Groth et al. | |
| 5,907,991 | A * | 6/1999 | Ramamoorthy et al. | 91/436 |
| 6,267,041 | B1 * | 7/2001 | Skiba et al. | 91/436 |
| 6,699,311 | B2 * | 3/2004 | Smith et al. | 91/436 |
| 7,913,491 | B2 * | 3/2011 | Lin et al. | 91/436 |

FOREIGN PATENT DOCUMENTS

| | | |
|---|---|---|
| JP | 56009533 | 1/1981 |
| JP | 56016738 | 2/1981 |
| JP | 03149402 | 6/1991 |
| JP | 07167107 | 7/1995 |
| JP | 07252862 | 10/1995 |
| JP | 10110447 | 4/1998 |
| JP | U61-204006 | 12/2008 |

* cited by examiner

*Primary Examiner* — Michael Leslie
(74) *Attorney, Agent, or Firm* — Fox Rothschild LLP

(57) ABSTRACT

A tank 16 and a main hydraulic pump 17 are connected to head side actuator chambers 13 and rod side actuator chambers 14 of hydraulic actuators 12 via conduits 21, 22. A direction control valve 18 and a quick drop valve 36 are connected to the conduits 21, 22. A hydraulic circuit is provided with an electromagnetic switch valve 42, which switches the quick drop valve 36 from a non-quick drop position 37 to a quick drop position 38. When switching the direction control valve 18 from a neutral position 23 to a lowering operation position 25, if the manipulation speed of a manipulation lever 33 exceeds a criteria speed, an excitation signal is output from a control device 32 to an electromagnetic switch valve 42 to quickly drop a blade 11, and the quick drop valve 36 is switched from the non-quick drop position 37 to the quick drop position 38.

7 Claims, 5 Drawing Sheets

WORKING MACHINE, AND QUICK LOAD-DROPPING METHOD

FIELD OF THE INVENTION

The present invention relates to a work machine that quickly drops a load such as a bulldozer blade that can be raised and lowered by hydraulic power and to a method for quickly dropping a load.

BACKGROUND OF THE INVENTION

In general, a bulldozer blade is raised and lowered by a double acting hydraulic actuator. A work machine such as a bulldozer includes a hydraulic system for driving the hydraulic actuator. An oil tank and a hydraulic pump, which configure the hydraulic system, are connected to the hydraulic actuator via conduits. Also, a direction control valve is connected to the conduits. The direction control valve controls the moving direction of the blade, which is selectively raised and lowered. The direction control valve is switched by a manipulation lever between a position for raising the blade from a neutral position and a position for lowering the blade from the neutral position. When leveling a ground by the bulldozer, in order to increase operation efficiency, an operator rotates the manipulation lever for raising and lowering the blade to the maximum operation angle to quickly drop the raised blade using its own weight.

Since the blade is heavy, quickly dropping the blade creates negative pressure inside actuator chambers and pipes. When the inside of the actuator chambers and the pipes is under negative pressure, air bubbles are generated in pressurized oil, and the operation of the hydraulic system might cause failure. To eliminate the problem, a quick drop circuit disclosed in patent document 1 is provided with a quick drop valve located in conduits between a direction control valve and hydraulic actuators. The hydraulic actuators are hydraulic cylinders each provided with a piston, and each includes first and second actuator chambers located on both sides of the piston. The blade is raised when oil is supplied to the first actuator chambers of the hydraulic actuators, and lowered when oil is supplied to the second actuator chambers of the hydraulic actuators. When quickly dropping the load, compressed high pressure oil in the first actuator chambers is directly supplied to the expanded second actuator chambers via the quick drop valve. Accordingly, the blade is quickly dropped while preventing generation of negative pressure in the actuator chambers and the pipes.

Patent document 1: Japanese Laid-Open Patent Publication No. 7-167107

SUMMARY OF THE INVENTION

However, according to the quick drop circuit disclosed in the above publication, since the quick drop valve is actuated by rotating the manipulation lever to the maximum operation angle, the operator needs to keep aware of the precise manipulation amount of the manipulation lever. Therefore, the quick drop valve might be actuated against the intention of the operator. In this case, the blade is quickly dropped, and the leveled road surface might be roughened.

Accordingly, it is an objective of the present invention to provide a work machine that reduces the possibility of quickly dropping a load against the intention of an operator and a method for quickly dropping a load.

To achieve the above objective, a first aspect of the present invention provides a work machine that selectively raises and lowers a load via a hydraulic circuit based on manipulation of a manipulation lever. The work machine includes speed detecting means, speed determining means, lever position detecting means, reference position determining means, and hydraulic control means. The speed detecting means detects manipulation speed of the manipulation lever. The speed determining means determines whether the manipulation speed of the manipulation lever exceeds a criteria speed. The lever position detecting means detects the position of the manipulation lever. The reference position determining means determines whether the position of the manipulation lever exceeds a criteria position. When the position of the manipulation lever exceeds the criteria position and the manipulation speed of the manipulation lever exceeds the criteria speed, the hydraulic control means actuates the hydraulic circuit to quickly drop the load.

According to the above-mentioned configuration, the quick drop operation is executed when the manipulation speed of the manipulation lever exceeds the criteria speed. Therefore, when the manipulation lever is manipulated slowly, the quick drop valve is not actuated. Also, in this case, if the manipulation lever is manipulated slowly from when manipulation of the manipulation lever in the lowering direction is started to when the position of the manipulation lever exceeds the criteria position, the load is not quickly dropped. Thus, the possibility that the quick drop operation is executed against the intention of the operator is reduced.

The above-mentioned work machine preferably further includes mode selecting means, which selects between a non-quick drop mode in which the quick drop operation due to the free fall of the load is invalidated and a quick drop mode in which the quick drop operation is performed. In this case, the mode selecting means can switch from the quick drop mode to the non-quick drop mode. Therefore, when the quick drop operation is unnecessary, the quick drop operation is prevented from being executed.

In the above-mentioned work machine, when a quick drop time measured from when the quick drop operation due to the free fall of the load has been started exceeds a criteria time, the hydraulic control means preferably stops the quick drop operation. In this case, the quick drop operation is appropriately cancelled, and collision of the load on the ground can be avoided.

In the above-mentioned work machine, when the height of the load becomes less than or equal to a criteria height when lowering the load, the hydraulic control means preferably stops the quick drop operation due to the free fall of the load. In this case, the quick drop operation is appropriately cancelled, and collision of the load on the ground can be avoided.

In the above-mentioned work machine, when a manipulation direction of the manipulation lever is switched from a lowering direction to a raising direction, the hydraulic control means preferably stops the quick drop operation due to the free fall of the load. In this case, the quick drop operation is appropriately cancelled, and collision of the load on the ground can be avoided.

The above-mentioned work machine further includes a hydraulic actuator for raising and lowering the load. The hydraulic actuator is a hydraulic cylinder including a piston, and is provided with first and second actuator chambers located on both sides of the piston. When pressurized oil is supplied to the first actuator chamber, the load is raised. When pressurized oil is supplied to the second actuator chamber, the load is lowered. When the pressure difference between the first actuator chamber and the second actuator chamber becomes less than or equal to a reference pressure difference, the hydraulic control means preferably stops the quick drop operation due to the free fall of the load. In this case, the quick drop operation is appropriately cancelled, and collision of the load on the ground can be avoided.

To achieve the above objective, a second aspect of the present invention provides a method for quickly dropping a load in a work machine that selectively raises and lowers the load via a hydraulic circuit based on manipulation of a manipulation lever. The method includes: detecting the position of the manipulation lever; comparing the detected position of the manipulation layer with a previously set criteria position; detecting the manipulation speed of the manipulation lever; comparing the detected manipulation speed with a previously set criteria speed; and performing free fall of the load when the position of the manipulation lever exceeds the criteria position and the detected manipulation speed exceeds the criteria speed.

DETAILED DESCRIPTION OF THE PREFERRED EMBODIMENTS

A work machine according to one embodiment of the present invention applied to a bulldozer will now be described with reference to FIGS. 1 to 4.

Figure 1:
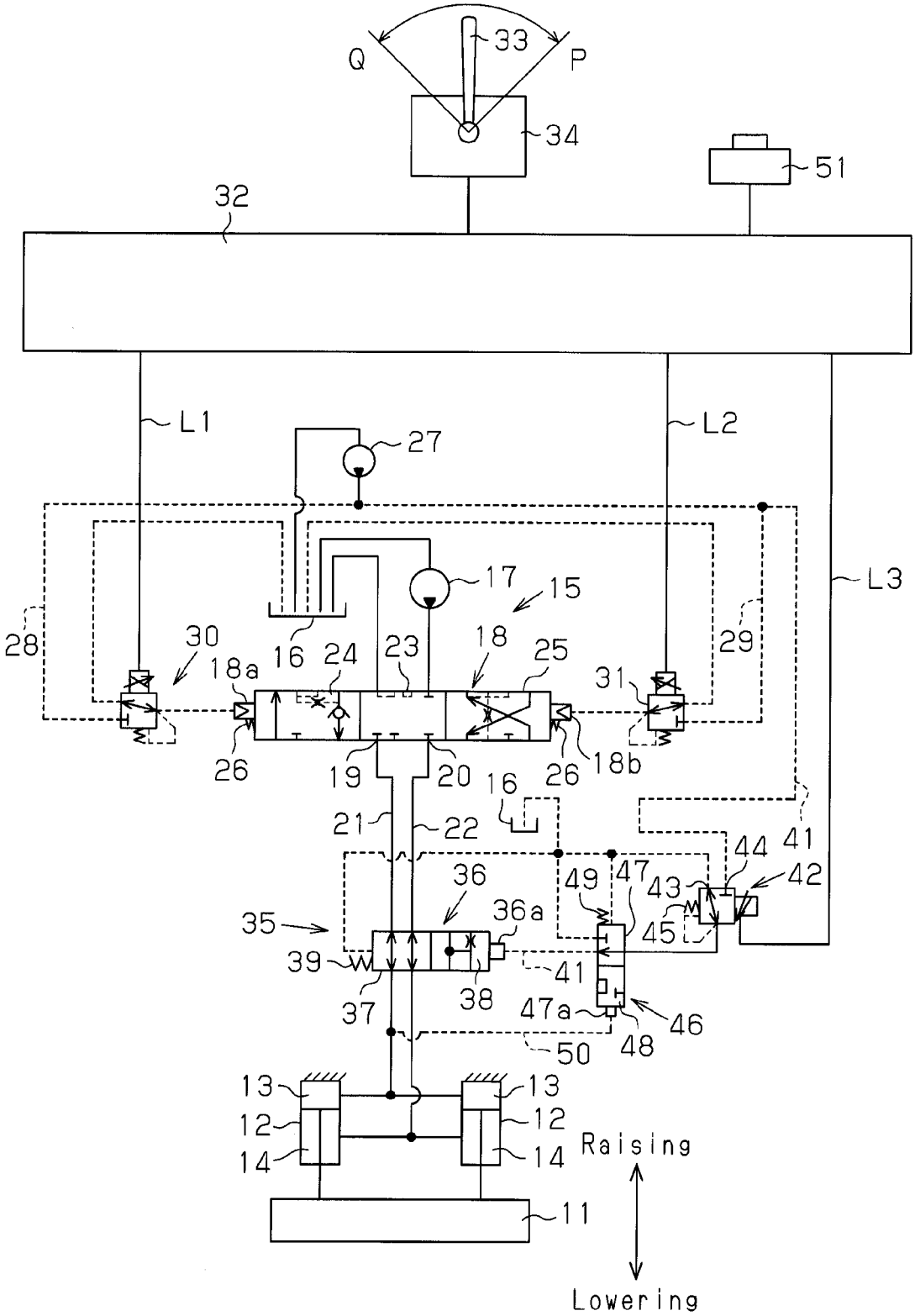
FIG. 1 is a circuit diagram illustrating one embodiment of the present invention applied to a hydraulic system for raising and lowering a bulldozer blade.

As shown in FIG. 1, the bulldozer includes a blade 11 as a load. The blade 11 is raised and lowered by a pair of double acting hydraulic actuators 12. More specifically, the hydraulic actuators 12 are hydraulic cylinders each provided with a piston. Each hydraulic actuator 12 includes a first actuator chamber, which is a rod side actuator chamber 14 in this embodiment, and a second actuator chamber, which is a head side actuator chamber 13 in this embodiment, on both sides of the associated piston. The blade 11 is lowered when pressurized oil is supplied to the head side actuator chambers 13, and is raised when pressurized oil is supplied to the rod side actuator chambers 14.

A hydraulic circuit 15, which actuates the hydraulic actuators 12, will now be described.

An oil tank 16 and a main hydraulic pump 17 are connected to a direction control valve 18 via conduits. The direction control valve 18 has inlet and outlet ports 19, 20. The inlet and outlet ports 19, 20 are connected to the head side actuator chambers 13 and the rod side actuator chambers 14 of the hydraulic actuators 12 via conduits 21, 22. The direction control valve 18 is selectively switched to a raising operation position 24 and a lowering operation position 25 from a neutral position 23. The direction control valve 18 is urged by two springs 26 to be retained at the neutral position 23.

The direction control valve 18 has, on its both ends, pilot pressure chambers 18*a*, 18*b*. Pilot pressure is selectively applied to one of the pilot pressure chambers 18*a*, 18*b* from a sub-hydraulic pump 27 via pilot conduits 28, 29. Accordingly, the direction control valve 18 is switched from the neutral position 23 to the raising operation position 24 or the lowering operation position 25. The pilot conduits 28, 29 are connected to electromagnetic flow control valves 30, 31 for controlling the pilot pressure. The flow control valves 30, 31 are urged by springs to be retained in a closed state.

The bulldozer is provided with a control device 32 including a microprocessor. A manipulation lever 33 for raising and lowering the blade 11 is provided at the driver's seat of the bulldozer. A potentiometer 34 is connected to the control device 32. The potentiometer 34 is coupled to the manipulation lever 33 and serves as speed detecting means and lever position detecting means. When the manipulation lever 33 is rotated from a neutral position shown by the solid line in FIG. 1 in a direction P (clockwise in FIG. 1), the potentiometer 34 detects the manipulation amount of the manipulation lever 33. Then, a drive signal is output to the flow control valve 30 from the control device 32 via a lead wire L1. Accordingly, the flow control valve 30 is actuated, and pilot pressure is supplied to the pilot pressure chamber 18*a* of the direction control valve 18 from the sub-hydraulic pump 27 via the pilot conduit 28. As a result, the direction control valve 18 is switched from the neutral position 23 to the raising operation position 24. Also, when the manipulation lever 33 is rotated in a direction Q (counterclockwise in FIG. 1), a drive signal is output to the flow control valve 31 from the control device 32 via a lead wire L2. Accordingly, pilot pressure is supplied to the pilot pressure chamber 18*b* of the direction control valve 18 from the sub-hydraulic pump 27 via the pilot conduit 29. As a result, the direction control valve 18 is switched from the neutral position 23 to the lowering operation position 25.

Thus, when the manipulation lever 33 is rotated in the direction P or Q from the neutral position, pressurized oil is supplied to the rod side actuator chambers 14 or the head side actuator chambers 13 of the hydraulic actuators 12, thereby raising or lowering the blade 11. At this time, as the manipulation amount is increased, that is, as the manipulation angle of the manipulation lever 33 is increased, the output voltage from the potentiometer 34 is increased, which also increases the operation amount of the flow control valves 30, 31. Accordingly, the opening amount of the pilot conduits 28, 29 is increased, thereby increasing the movement of the direction control valve 18, which increases the raising speed or the lowering speed of the blade 11.

A quick drop circuit 35, which quickly lowers the blade 11, will now be described.

A quick drop valve 36, which configures the quick drop circuit 35, is connected to the conduits 21, 22, which connect the direction control valve 18 and the hydraulic actuators 12 to each other. The quick drop valve 36 is switched between a non-quick drop position 37, at which the conduits 21, 22 are disconnected from each other, and a quick drop position 38, at which the conduits 21, 22 are connected to each other. When the quick drop valve 36 is switched to the quick drop position 38, since the conduits 21, 22 are connected to each other, oil is supplied from the rod side actuator chambers 14 of the hydraulic actuators 12 to the head side actuator chambers 13 of the hydraulic actuators 12. Accordingly, the blade 11 is freely dropped by its own weight. The quick drop valve 36 is urged by the spring 39 to be retained at the non-quick drop position 37.

The quick drop valve 36 includes a pilot pressure chamber 36*a* provided at the quick drop position 38. The pilot pressure chamber 36*a* is connected to the sub-hydraulic pump 27 via a conduit 41 and an electromagnetic switch valve 42. The electromagnetic switch valve 42 is electrically connected to the control device 32 via a lead wire L3. The electromagnetic switch valve 42 is switched between a drain port 43, which connects the pilot pressure chamber 36*a* of the quick drop valve 36 to the oil tank 16, and a communication port 44, which connects the pilot pressure chamber 36*a* to the conduit 41. The electromagnetic switch valve 42 is urged by a spring 45 to be retained at the drain port 43.

Therefore, when an excitation signal output from the control device 32 is input to the electromagnetic switch valve 42, so that the electromagnetic switch valve 42 is switched from the drain port 43 to the communication port 44, pilot pressure is supplied to the pilot pressure chamber 36*a* from the sub-hydraulic pump 27 via the electromagnetic switch valve 42. Accordingly, the quick drop valve 36 is switched from the non-quick drop position 37 to the quick drop position 38 against the force of the spring 39.

The conduit 41 between the electromagnetic switch valve 42 and the quick drop valve 36 is provided with a quick drop cancelling valve 46 for switching the quick drop valve 36 from the quick drop position 38 to the non-quick drop position 37. The quick drop cancelling valve 46 includes a communication port 47, which opens the conduit 41, and a drain port 48, which connects the pilot pressure chamber 36*a* to the oil tank 16. The quick drop cancelling valve 46 is urged by a spring 49 to be retained at the communication port 47. The quick drop cancelling valve 46 is provided with a pilot pressure chamber 47*a* located at the drain port 48. Pressure in the conduit 21, which communicates with the head side actuator chambers 13, is applied to the pilot pressure chamber 47*a* via a pilot conduit 50.

Therefore, when the blade 11 is quickly dropped and stopped on the ground surface in a state where the quick drop valve 36 is switched to the quick drop position 38, the pistons of the hydraulic actuators 12 are also stopped. Thus, the pressure in the head side actuator chambers 13 of the hydraulic actuators 12 is increased beyond a predetermined pressure by the oil supplied from the main hydraulic pump 17. Accordingly, the quick drop cancelling valve 46 is switched to the drain port 48 against the force of the spring 49. As a result, the quick drop valve 36 is switched from the quick drop position 38 to the non-quick drop position 37 by the spring 39.

As shown in FIG. 1, mode selecting means, which is a mode selecting switch 51 in this embodiment, is connected to the control device 32. The mode selecting switch 51 is for selecting modes between a non-quick drop mode, in which output of the excitation signal to the electromagnetic switch valve 42 is stopped, and a quick drop mode, in which the excitation signal is output to the electromagnetic switch valve 42.

Figure 2:
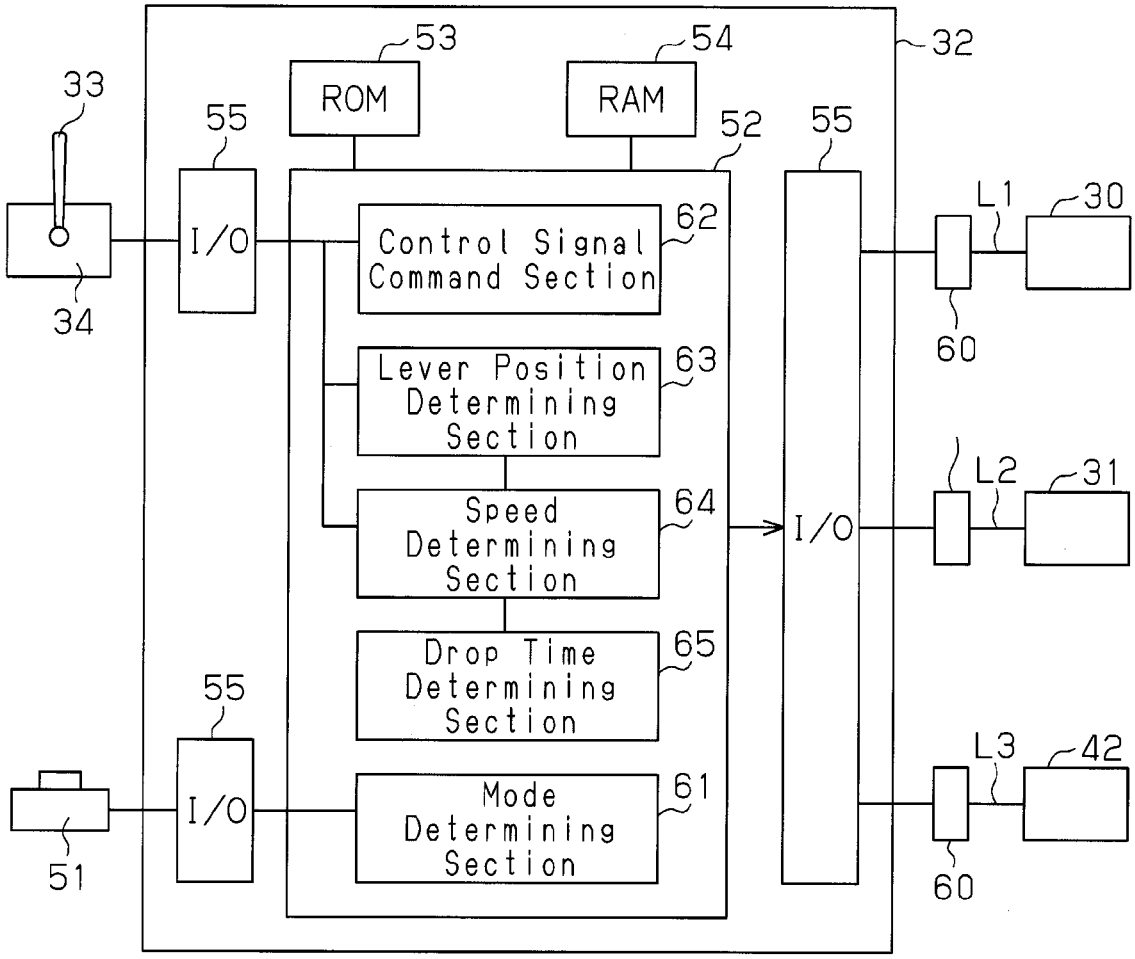
FIG. 2 is a block circuit diagram of a control device.

The configuration and function of the control device 32 will now be described with reference to FIG. 2.

The control device 32 is provided with a microprocessor (MPU) 52 for executing various types of computation processes. A read-only memory (ROM) 53 and a random access memory (RAM) 54 are connected to the MPU 52. The ROM 53 serves as a storing medium, which stores programs for performing various types of control operations of the bulldozer. The RAM 54 serves as a storing medium for storing various types of data. A potentiometer 34 is connected to the MPU 52 via an analog-to-digital converter, which is not shown, and an interface 55. A voltage value detected by the potentiometer 34 is input to the MPU 52 as a digital signal. The mode selecting switch 51 is connected to the MPU 52 via an interface 55. The MPU 52 receives a mode selection signal from the mode selecting switch 51. The flow control valves 30, 31 and the electromagnetic switch valve 42 are connected to the MPU 52 via an interface 55 and drive circuits 60. An input device (not shown) such as a keyboard and a display device (not shown) including a display are connected to the MPU 52.

The MPU 52 is provided with a mode determining section 61 for determining mode selection signals output from the mode selecting switch 51. Also, the MPU 52 is provided with a control signal command section 62, which outputs control signals to the flow control valves 30, 31 in accordance with the position of the manipulation lever 33. The control signal command section 62 controls the flow control valves 30, 31. The MPU 52 is provided with reference position determining means, which is a lever position determining section 63 in this embodiment. The lever position determining section 63 determines whether the actual position of the manipulation lever 33 is beyond a reference position (reference lever position) stored in the ROM 53. Furthermore, the MPU 52 is provided with speed determining means, which is a speed determining section 64 in this embodiment. The speed determining section 64 determines whether the manipulation speed of the manipulation lever 33 in the lowering direction exceeds a criteria speed stored in the ROM 53. The MPU 52 is provided with a quick drop time determining section 65. The quick drop time determining section 65 determines whether a drop time measured from when a quick drop operation is started exceeds a criteria time stored in the ROM 53.

The operations of the hydraulic circuit 15 and the quick drop circuit 35 of the bulldozer will now be described mainly with reference to FIGS. 3 and 4.

In a state where the blade 11 is retained at the raised position, the pressure of the rod side actuator chambers 14 is increased due to the weight of the blade 11, and the pressure of the head side actuator chambers 13 becomes lower than the predetermined pressure. Thus, the quick drop cancelling valve 46 is retained at the communication port 47 by the force of the spring 49. In this state, pilot pressure is supplied to the pilot pressure chamber 36*a* of the quick drop valve 36 from the sub-hydraulic pump 27 via the conduit 41.

First, raising and lowering operations of the blade 11 when the mode selecting switch 51 shown in FIG. 1 is switched to the non-quick drop mode will now be described. In this case, since the excitation signal is not output from the control device 32 to the electromagnetic switch valve 42, the quick drop valve 36 is retained at the non-quick drop position 37 by the force of the spring 39. When the manipulation lever 33 is rotated in the direction Q of FIG. 1, in accordance with the manipulation position of the manipulation lever 33, a control signal is output from the control device 32 to the flow control valve 31. As a result, the direction control valve 18 is switched from the neutral position 23 to the lowering operation position 25, causing the blade 11 to be lowered. When the manipulation lever 33 is rotated in the direction P of FIG. 1, in accordance with the manipulation position of the manipulation lever 33, a control signal is output from the control device 32 to the flow control valve 30. As a result, the direction control valve 18 is switched to the raising operation position 24, causing the blade 11 to be raised.

Next, raising and lowering operations of the blade 11 when the mode selecting switch 51 is switched to the quick drop mode will now be described with reference to the flowchart of FIG. 3. The series of processes shown in FIG. 3 are executed by the control of MPU 52. The programs for executing the processes are stored in the ROM 53.

Figure 3:
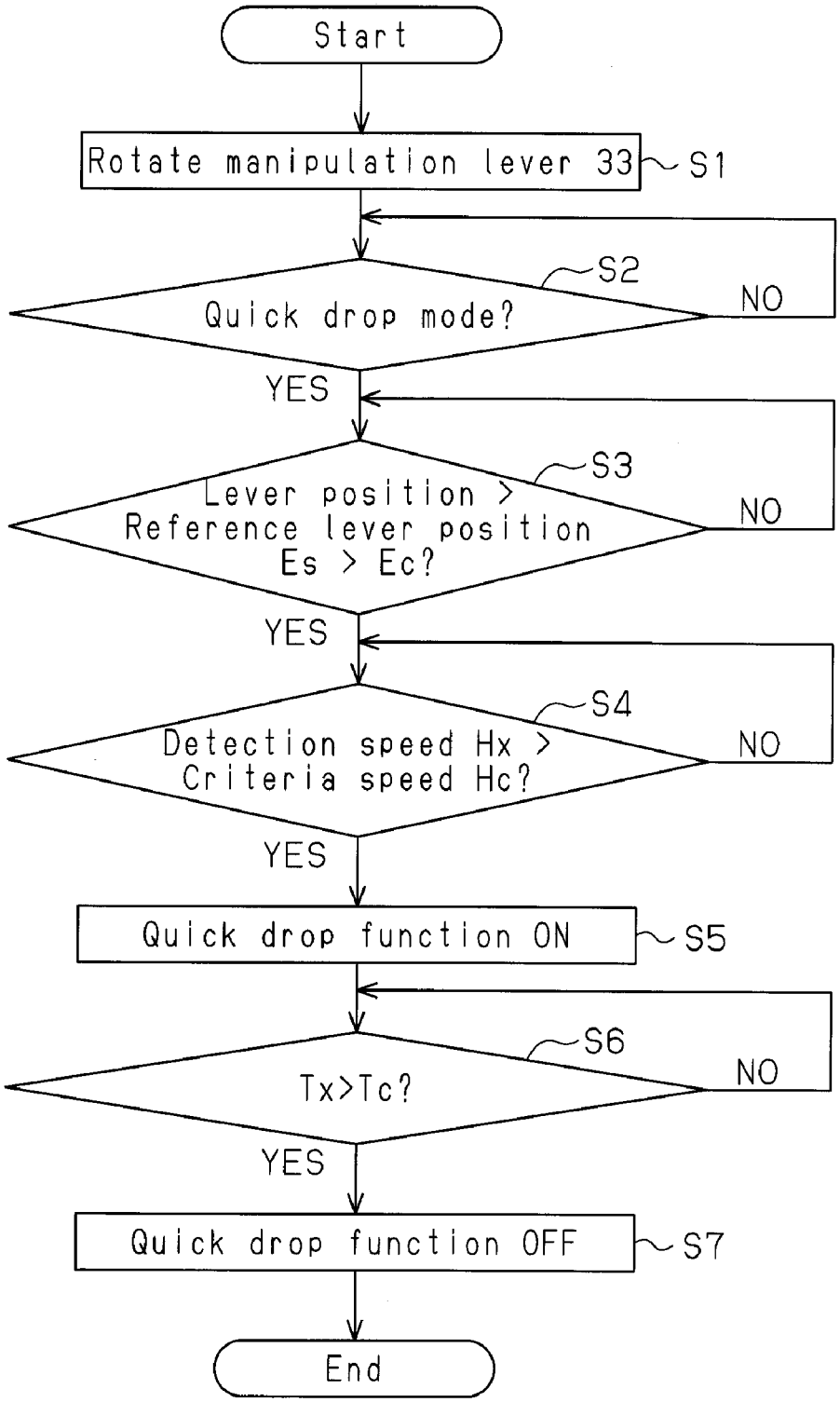
FIG. 3 is a flowchart explaining a quick drop operation of the blade.

As shown in FIG. 3, in step S1, when the manipulation lever 33 is rotated in the direction Q of FIG. 1, in step S2, the mode determining section 61 determines whether the mode selecting switch 51 is switched to the quick drop mode. If the decision outcome of step S2 is positive, in step S3, the lever position determining section 63 determines whether the rotation position of the manipulation lever 33 in the lowering direction, that is, the lever position exceeds the reference lever position previously set in the ROM 53. The determination is performed as follows. As shown in FIG. 4, a maximum voltage value Emax, which is output from the potentiometer 34 when the manipulation lever 33 is arranged at the maximum lowering position, and a reference voltage value Ec (set to, for example, 70% of Emax), which is lower than the maximum voltage value Emax, are previously stored in the ROM 53. The lever position determining section 63 determines whether a detection voltage value Es output from the potentiometer 34 exceeds the reference voltage value Ec.

If the decision outcome of step S3 is positive, in step S4, it is determined whether the manipulation speed (detection speed Hx) of the manipulation lever 33 is greater than a criteria speed Hc. That is, when the manipulation lever 33 is rotated, it is determined whether changes in the detection voltage value Es per unit time, that is, the detection speed Hx is greater than the criteria speed Hc previously stored in ROM 53. If the decision outcome of step S4 is positive, in step S5, an excitation signal is output from the control device 32 to the electromagnetic switch valve 42, so that the electromagnetic switch valve 42 is switched to the communication port 44. Then, pilot pressure is supplied to the pilot pressure chamber 36*a* of the quick drop valve 36 from the sub-hydraulic pump 27 via the conduit 41. Accordingly, the quick drop valve 36 is switched from the non-quick drop position 37 to the quick drop position 38, so that the quick drop function is switched on. As a result, the head side actuator chambers 13 of the hydraulic actuators 12 and the rod side actuator chambers 14 of the hydraulic actuators 12 are connected, so that the blade 11 is freely dropped by its own weight, and is quickly lowered.

Figure 4:
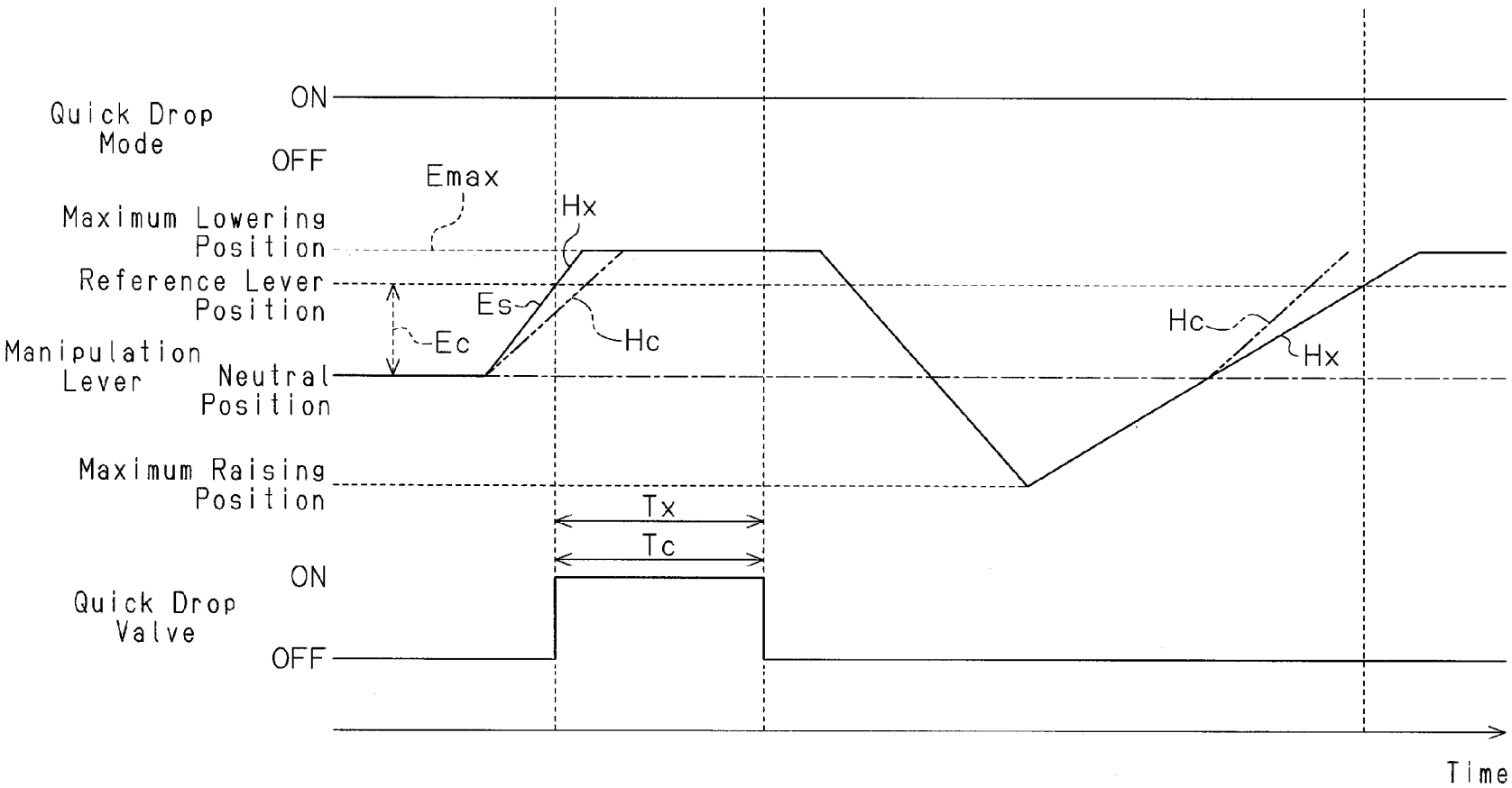
FIG. 4 is a timing chart explaining the quick drop operation of the blade.

Next, as shown in FIG. 4, in step S6, it is determined whether the quick drop time Tx exceeds the criteria time Tc previously stored in the RAM 54. The quick drop time Tx is measured by the quick drop time determining section 65 from when a quick drop operation has been started, that is, from when the detection voltage value Es has exceeded the reference voltage value Ec. If the decision outcome of step S6 is positive, the excitation signal output to the electromagnetic switch valve 42 from the control device 32 via the lead wire L3 is interrupted, and in step S7, the quick drop function is switched off.

In a state where the manipulation lever 33 is held at the maximum lowering position after the quick drop operation is switched off, the detection voltage value Es output from the potentiometer 34 is maintained to the maximum voltage value Emax. When the manipulation lever 33 is rotated in the direction P (raising direction) of FIG. 1 after the quick drop valve 36 is switched to the non-quick drop position 37, the detection voltage value Es output from the potentiometer 34 is reduced accordingly. Then, when the manipulation lever 33 is arranged at the neutral position, the detection voltage value Es becomes zero. When the manipulation lever 33 is further rotated in the raising direction, the detection voltage value Es is further reduced accordingly. When the manipulation lever 33 is rotated from the maximum raising position to the maximum lowering position slowly, even if the lever position (voltage value Es) exceeds the reference lever position (voltage value Ec), the detection speed Hx of the manipulation lever 33 does not exceed the criteria speed Hc. Thus, the quick drop valve 36 is not switched to the quick drop position 38.

In the first embodiment, the control device 32, the quick drop circuit 35, the quick drop valve 36, and the electromagnetic switch valve 42 configure hydraulic control means, which actuates the hydraulic circuit 15 to quickly drop the blade 11 when the detection speed Hx of the manipulation lever 33 is determined to have exceeded the criteria speed Hc.

The hydraulic system of the first embodiment has the following advantages.

(1) When the detection speed Hx of the manipulation lever 33 exceeds the criteria speed Hc, the quick drop valve 36 is actuated. Therefore, when quickly dropping the blade 11, the operator does not need to be aware of the position of the manipulation lever 33, and the operator only needs to manipulate the manipulation lever 33 quickly in the lowering direction. That is, when manipulating the manipulation lever 33 slowly, the quick drop valve 36 is not actuated. This reduces the possibility that the quick drop valve 36 is actuated against the intention of the operator.

(2) When the position of the manipulation lever 33 exceeds the reference lever position, the excitation signal is output to the electromagnetic switch valve 42 from the control device 32, and the blade 11 is quickly dropped. That is, when the manipulation lever 33 is manipulated slowly from when manipulation of the manipulation lever 33 in the lowering direction is started to when the position of the manipulation lever 33 exceeds the criteria position, the blade 11 is not quickly dropped. This further reduces the possibility that the quick drop operation is performed against the intention of the operator.

(3) The operator can switch from the quick drop mode to the non-quick drop mode using the mode selecting switch 51. Therefore, when the quick drop operation is unnecessary, the non-quick drop mode is selected. Thus, the ground is leveled by the blade 11 safely.

(4) When the quick drop time Tx measured by the quick drop time determining section 65 reaches the criteria time Tc from when the quick drop operation has been started, the quick drop valve 36 is switched from the quick drop position 38 to the non-quick drop position 37. By appropriately controlling the quick drop time as described above, the blade 11 is prevented from freefalling and crashing on the ground surface. This prevents hunting of the blade 11.

The first embodiment may be modified as follows.

Instead of the quick drop time determining operation in step S6 shown in FIG. 3, the height of the blade 11 may be detected based on the stroke amount of the hydraulic actuators 12. Based on the height of the blade 11, the quick drop valve 36 may be switched from the quick drop position 38 to the non-quick drop position 37. In this case, the blade 11 is prevented from freefalling and crashing on the ground surface, thereby preventing hunting.

Also, the quick drop valve 36 may be switched from the quick drop position 38 to the non-quick drop position 37 when a signal indicating that the manipulation lever 33 is rotated in the raising direction is output to the MPU 52 from a direction detector, which detects the manipulation direction of the manipulation lever 33, in the case where the manipulation lever 33 is rotated in the lowering direction. In this case also, the blade 11 is prevented from freefalling and crashing on the ground surface, thereby preventing hunting.

Furthermore, the quick drop valve 36 may be switched from the quick drop position 38 to the non-quick drop position 37 when the pressure difference detected by a pressure difference detector, which detects the pressure difference between the head side actuator chambers 13 of the hydraulic actuators 12 and the rod side actuator chambers 14 of the hydraulic actuators 12, becomes less than or equal to a predetermined reference pressure difference. This utilizes the phenomenon that immediately after starting the quick drop operation, the pressure in the rod side actuator chambers 14 is higher than the pressure in the head side actuator chambers 13 due to the weight of the blade 11, and the pressure difference is significant, but the pressure difference is gradually reduced as the time elapses from the starting of the quick drop operation, since pressurized oil is supplied from the rod side actuator chambers 14 to the head side actuator chambers 13. In this case also, the blade 11 is prevented from freefalling and crashing on the ground surface, thereby preventing hunting.

Figure 5:
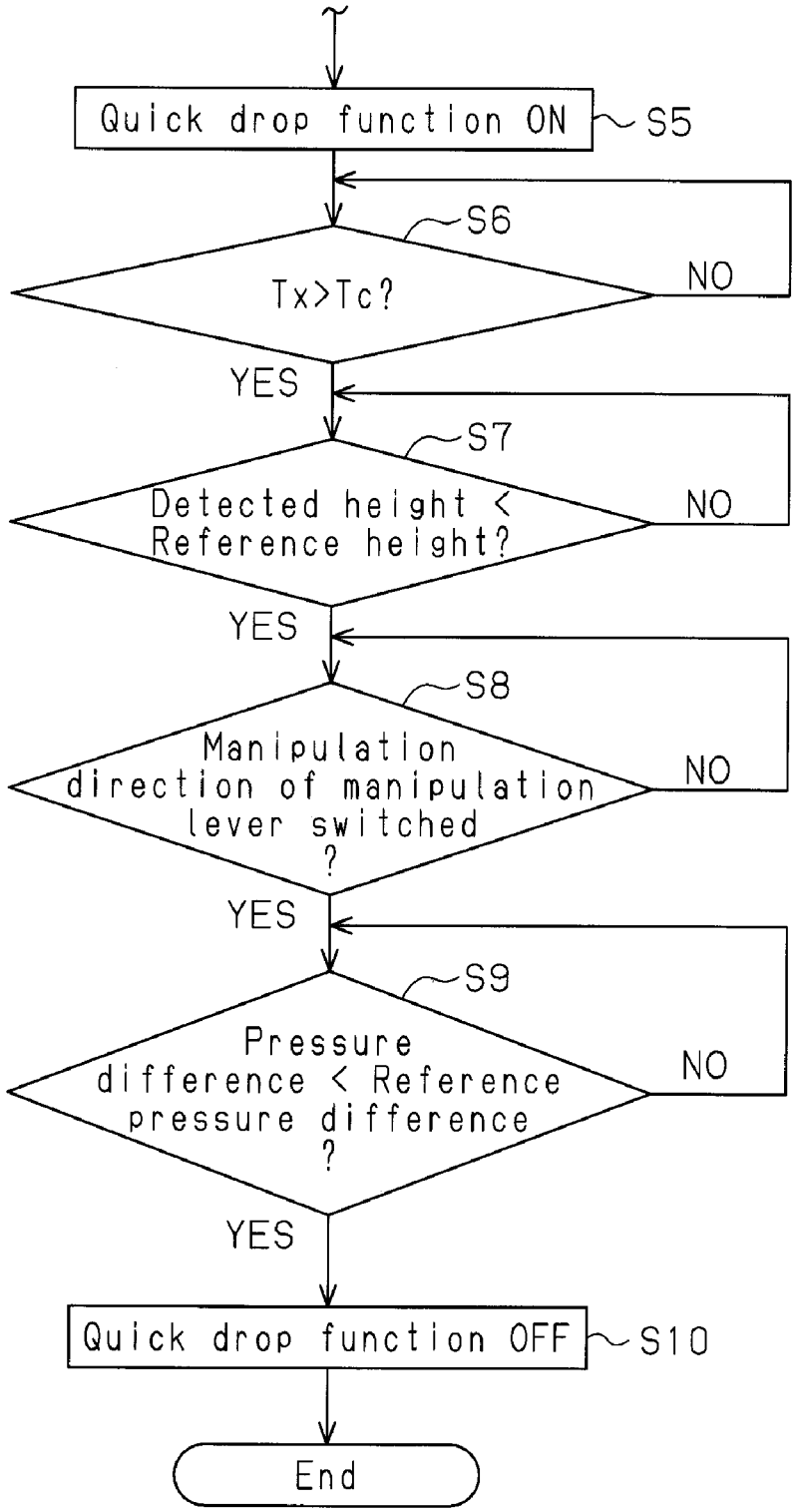
FIG. 5 is a flowchart illustrating a modified embodiment of the present invention.

As shown in FIG. 5, the quick drop valve 36 may be switched from the quick drop position 38 to the non-quick drop position 37 when all of the following quick drop cancelling conditions are satisfied or when two or three of the four cancelling conditions are satisfied. The quick drop cancelling conditions are as follows: the quick drop time Tx measured from when the quick drop operation of the blade 11 has been started exceeds the criteria time Tc as shown in step S6; the detected height of the blade 11 is less than or equal to the reference height as shown in step S7; the manipulation direction of the manipulation lever 33 is switched as shown in step S8; and the pressure difference between the head side actuator chambers 13 of the hydraulic actuators 12 and the rod side actuator chambers 14 of the hydraulic actuators 12 is less than or equal to the reference pressure difference as shown in step S9.

The quick drop valve 36 may be directly switched by an electromagnetic solenoid. In this case, as a method for cancelling the quick drop operation, a non-excitation signal may be output from the control device 32 to the electromagnetic solenoid using at least one of the above-mentioned four cancelling conditions, so that the quick drop valve 36 is switched to the non-quick drop position 37.

The lever position determining section 63 may be omitted, and the quick drop valve 36 may be switched to the quick drop position 38 in accordance with only the manipulation speed of the manipulation lever 33.

The present invention may be embodied in, for example, a hydraulic system that raises and lowers a load such as a bucket of a hydraulic excavator.

The manipulation lever may be formed by a manipulation member that reciprocates linearly or a manipulation member that rotates.

The invention claimed is:

1. A work machine that selectively raises and lowers a load via a hydraulic circuit based on manipulation of a manipulation lever, the work machine comprising:

speed detecting means, which detects manipulation speed of the manipulation lever;

speed determining means, which determines whether the manipulation speed of the manipulation lever exceeds a criteria speed;

lever position detecting means, which detects the position of the manipulation lever;

reference position determining means, which determines whether the position of the manipulation lever exceeds a criteria position, and hydraulic control means, wherein, when the position of the manipulation lever exceeds the criteria position and the manipulation speed of the manipulation lever exceeds the criteria speed, the hydraulic control means actuates the hydraulic circuit to perform free fall of the load.

2. The work machine according to claim 1, comprising:

mode selecting means, which selects between a non-quick drop mode in which the quick drop operation due to the free fall of the load is invalidated and a quick drop mode in which the quick drop operation is allowed.

3. The work machine according to claim 1, wherein when a quick drop time measured from when the quick drop operation due to the free fall of the load has been started exceeds a criteria time, the hydraulic control means stops the quick drop operation.

4. The work machine according to claim 1, wherein when the height of the load becomes less than or equal to a criteria height when lowering the load, the hydraulic control means stops the quick drop operation due to the free fall of the load.

5. The work machine according to claim 1, wherein when a manipulation direction of the manipulation lever is switched from a lowering direction to a raising direction, the hydraulic control means stops the quick drop operation due to the free fall of the load.

6. The work machine according to claim 1 comprising:

a hydraulic actuator for raising and lowering the load, wherein the hydraulic actuator is a hydraulic cylinder including a piston, and is provided with first and second actuator chambers located on both sides of the piston, wherein, when pressurized oil is supplied to the first actuator chamber, the load is raised, wherein, when pressurized oil is supplied to the second actuator chamber, the load is lowered, and wherein, when the pressure difference between the first actuator chamber and the second actuator chamber becomes less than or equal to a reference pressure difference, the hydraulic control means stops the quick drop operation due to the free fall of the load.

7. A method for quickly dropping a load in a work machine that selectively raises and lowers the load via a hydraulic circuit based on manipulation of a manipulation lever, the method comprising:

detecting the position of the manipulation lever;

comparing the detected position of the manipulation laver with a previously set criteria position;

detecting the manipulation speed of the manipulation lever;

comparing the detected manipulation speed with a previously set criteria speed; and performing free fall of the load when the position of the manipulation lever exceeds the criteria position and the detected manipulation speed exceeds the criteria speed.

* * * * *